US006212695B1

(12) United States Patent
Arduini

(10) Patent No.: US 6,212,695 B1
(45) Date of Patent: Apr. 10, 2001

(54) WATER CLOSET PAN WITH ARM RESTS

(75) Inventor: Giovanni Arduini, Milan (IT)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/463,283

(22) PCT Filed: May 15, 1998

(86) PCT No.: PCT/EP98/03012

§ 371 Date: Apr. 24, 2000

§ 102(e) Date: Apr. 24, 2000

(87) PCT Pub. No.: WO99/04678

PCT Pub. Date: Feb. 4, 1999

(30) Foreign Application Priority Data

Jul. 21, 1997 (IT) ..... RE970034 U

(51) Int. Cl.[7] ..... E03D 11/00
(52) U.S. Cl. ..... 4/254
(58) Field of Search ..... 4/254, 667

(56) References Cited

U.S. PATENT DOCUMENTS

| | | | | |
|---|---|---|---|---|
| 3,474,471 | | 10/1969 | Matibag et al. | 4/254 |
| 3,921,236 | * | 11/1975 | Klein | 4/254 |
| 4,196,480 | * | 4/1980 | Guenther et al. | 4/254 |

FOREIGN PATENT DOCUMENTS

| | | | | |
|---|---|---|---|---|
| 140909 | * | 9/1930 | (CH) | 4/254 |
| 0777 994 | | 6/1997 | (EP) . | |

* cited by examiner

*Primary Examiner*—Robert M. Fetsuga

(57) ABSTRACT

There are provided a retention means (10) to be positioned in a completely hidden manner within the rear part of the pan (2), and be rigidly fixed to the floor or wall in such a manner as to be supported thereby, and a pair of arm rests (20) which each have one end fixed to the retention means (10) and are supported thereby; the pan (2) is arranged to be fixed to the floor or wall without loading the retention means (10) and vice versa, and has a pair of holes (41) provided in the vertical side walls of its rear part, through which holes the end of the arm rests (20) is fixed to the retention means (10) without loading the pan (2).

10 Claims, 10 Drawing Sheets

WATER CLOSET PAN WITH ARM RESTS

TECHNICAL FIELD

This invention relates to water closet pans having arm rests for aiding the user, in particular for persons of defective musculature, ie persons with a muscular system which is not completely efficient, such as elderly persons and paraplegics.

BACKGROUND ART

Specifically, the invention concerns the technical problem of fixing and supporting the arm rests on the pan which, being typically of ceramic material, itself presents technical problems with regard to the arm rest fixings and with regard to the stresses to which it is subjected by the weight of the user. The said technical problem is solved by the invention, as characterised in the claims.

DISCLOSURE OF THE INVENTION

The invention comprises a retention means, arranged to be positioned in a completely hidden manner within the rear part of the pan, and to be rigidly fixed to the floor or wall in such a manner as to be supported thereby. The pan is arranged to be fixed to the floor or wall without loading the retention means and vice versa, and has a pair of holes provided in the vertical side walls of its rear part, through which holes the end of the arm rests is fixed to the retention means without loading the pan. A pair of pins of transverse horizontal axis are fixed to the lateral walls of the retention means, and emerge from the pan through said holes provided in the vertical side walls of the rear part of the pan. Close to one of its ends, each arm rest possesses a bush arranged to rotatably engage with a respective said pin.

The invention is described in detail hereinafter with the aid of the accompanying figures, which illustrate a non-exclusive embodiment thereof.

Figure 1:
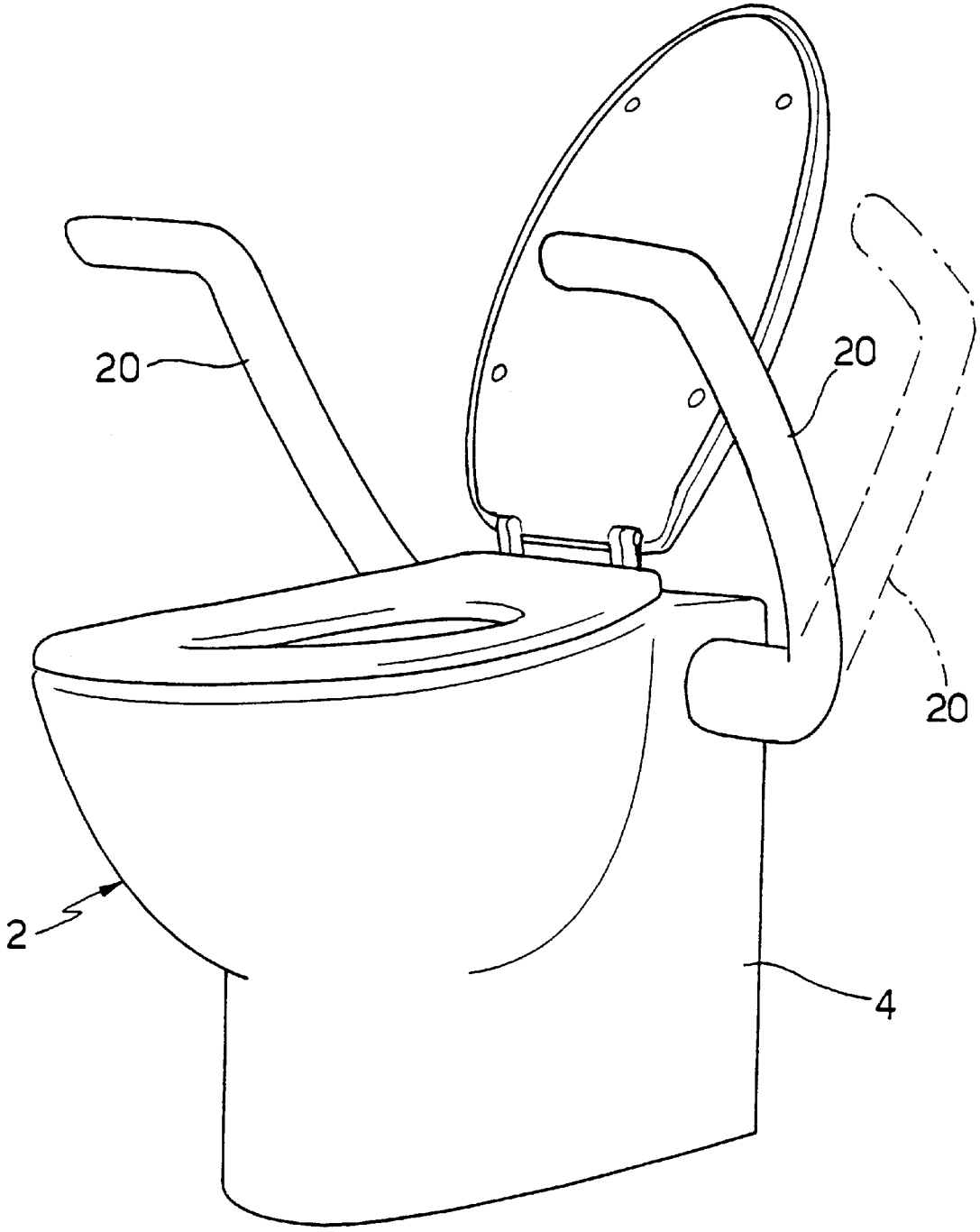
FIG. 1 is a perspective view of a water closet pan with arm rests, according to the invention, in the version with the pan fixed to the floor.
Figure 2:
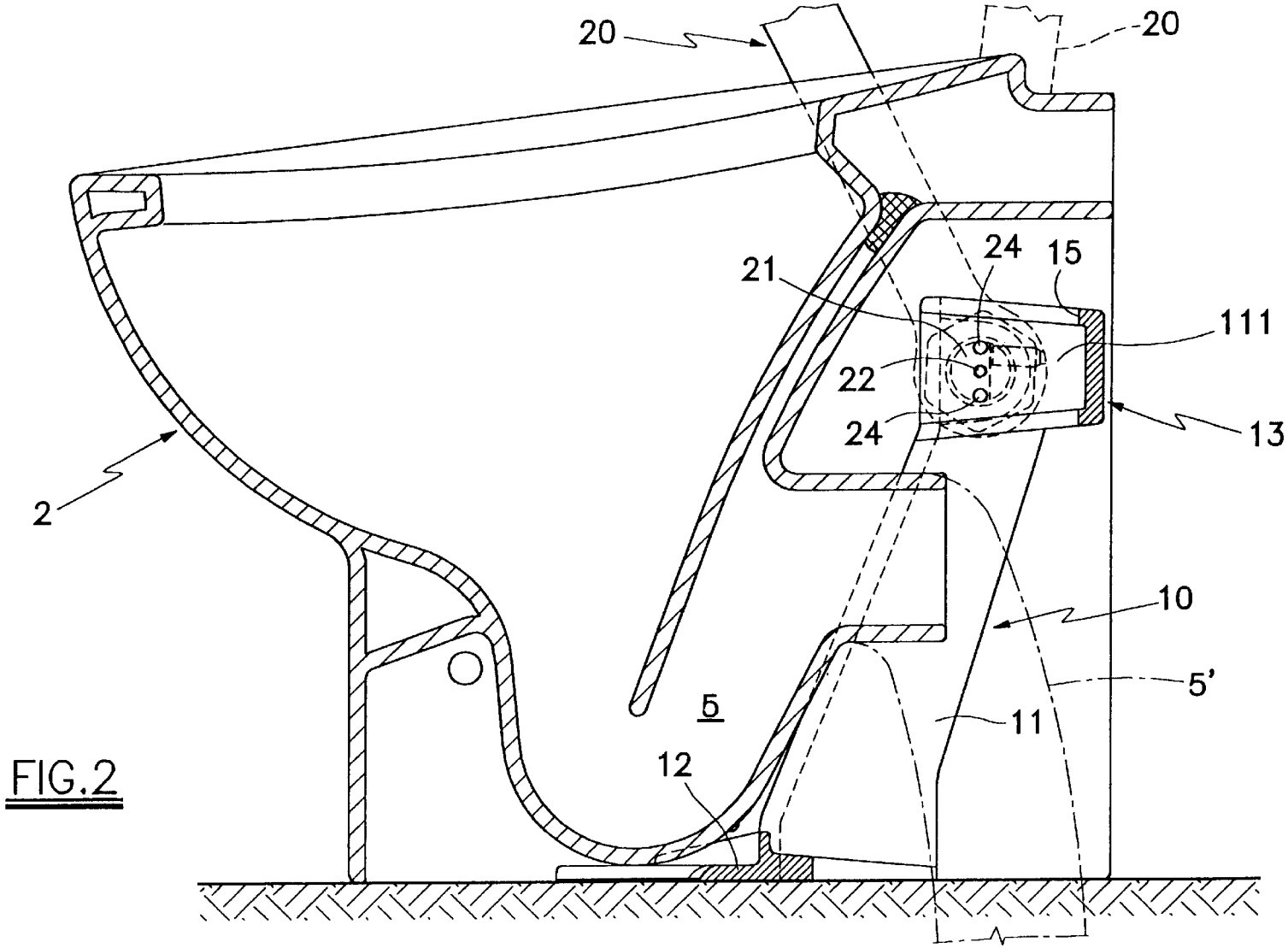
FIG. 2 is a section on the vertical longitudinal plane of symmetry of the pan of FIG. 1.
Figure 3:
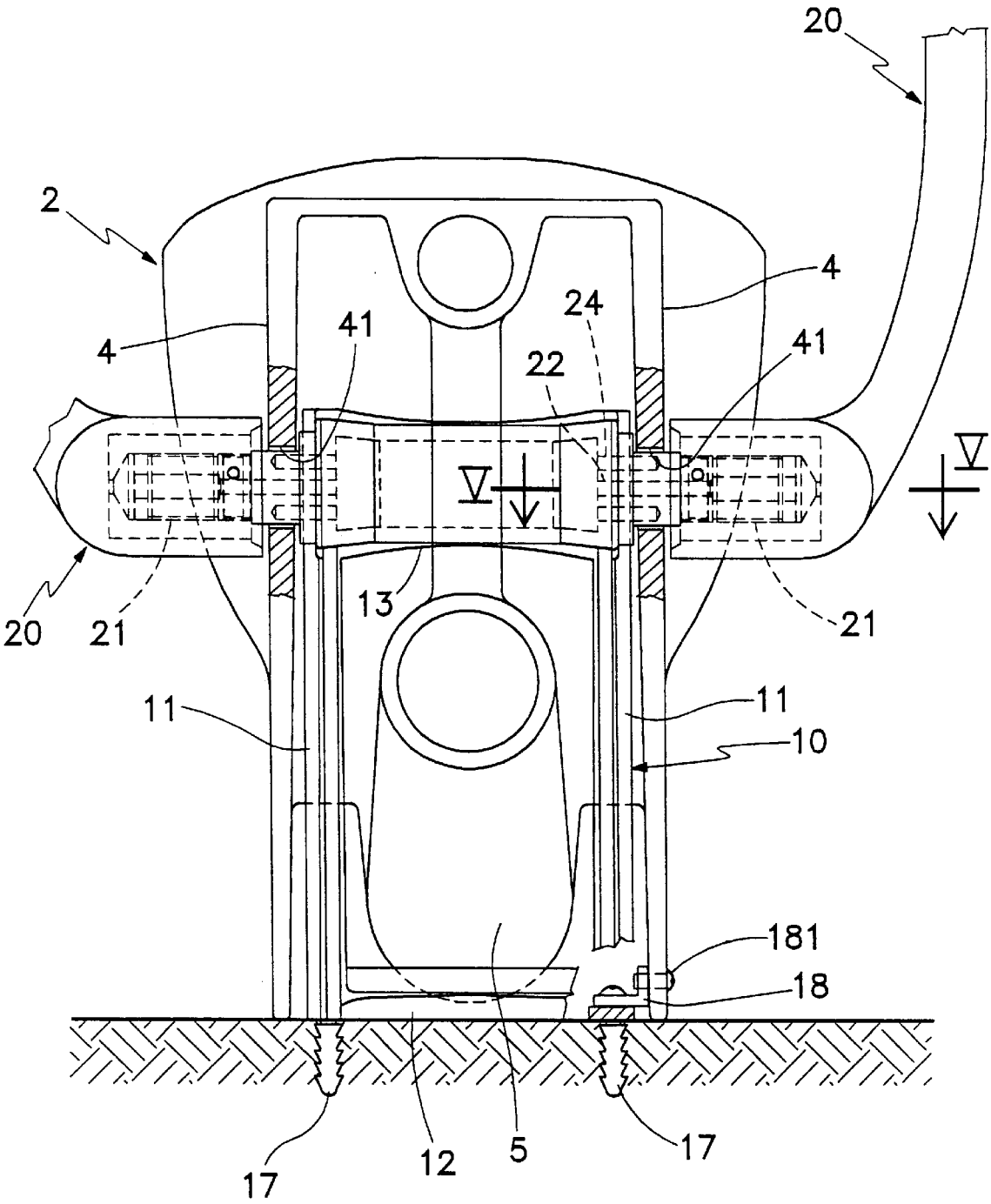
FIG. 3 is a view from the rear in FIG. 1.
Figure 4:
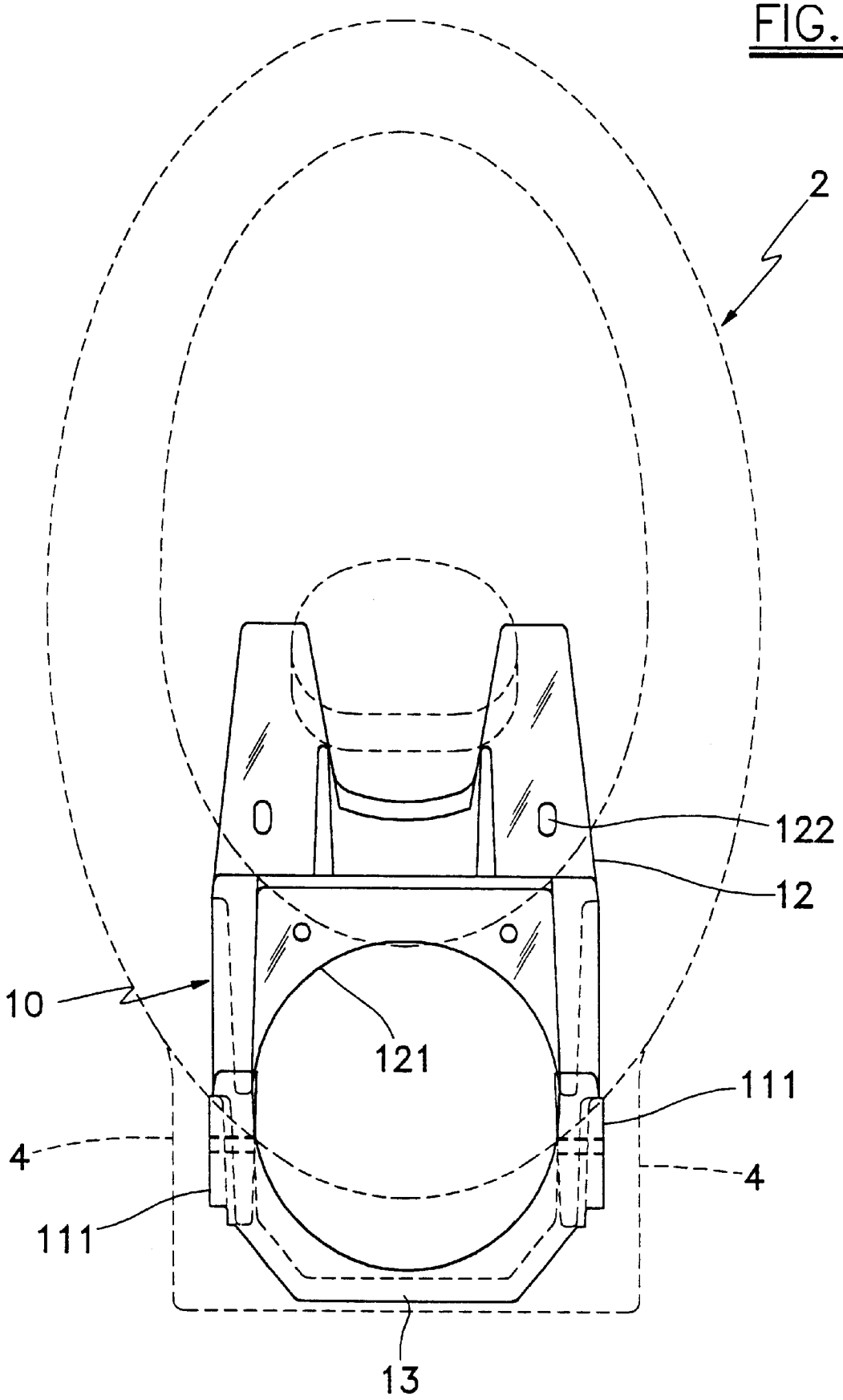
FIG. 4 is a plan view taken from above in FIG. 1.

According to the invention, there is provided a retention means 10 arranged to lie in a position in which it is completely hidden within the rear part of the water closet pan, and to be rigidly fixed to the floor or wall in such a manner as to be supported thereby. In addition, the pan 2 is arranged to be fixed to the floor or wall without loading the retention means 10 and vice versa.

In the version in which the pan 2 is of the floor-mounted type, said retention means 10 has the overall form of a vertically extending shell, for positioning within the rear part of the pan 2, and having a base 12 to be fixed to the floor and two vertical facing lateral walls 11 close to the vertical side walls 4 of the rear part of the pan.

In the illustrated embodiment, the retention means 10 substantially comprises two parallel, substantially flat vertical lateral walls 11, and a base 12 consisting of the profiled flat plate which joins together the lower ends of the lateral walls 11.

Finally a U-shaped upper member 13 with its concavity facing forwards is provided to join together the upper portions of the lateral walls 11.

The upper member 13 is in line with the walls 11 and is substantially coplanar with the rear ends of the side walls 4 of the pan 2.

The form and dimensions of the retention means 10 are such that, whereas the base 12 rests on the floor, the two lateral walls 11 face each other and are close to the vertical side walls 4 of the rear part of the pan.

In the lower part of the retention means 10 below the member 13 there is housed the rear end of the discharge conduit 5 of the pan 2, which in the embodiment shown in FIGS. 1–4 is of the type which leaves horizontally, passing below the member 13, to connect to a port provided in the wall.

Alternatively (embodiment shown by dashed lines in FIG. 2) the discharge 5' descends downwards to pass behind a cut-out provided in the rear side of the base 12. The retention means 10 is typically of metal and is strengthened by suitable ribs 15 between the walls 11 and the member 13 and by ribs 16 on the base 12. The base 12 of the retention means 10 is fixed to the floor together with usual fixing screws by which the pan 2 is also fixed.

The base 12 is fixed to the floor, together with angle pieces placed on the base 12, by usual screws and expansion plugs 17 which are positioned through through holes 122 provided in the base 12. The pan 2 is fixed to the angle pieces 18 by horizontal screws 181 inserted from the outside, to pass through appropriate holes formed in the sides of the pan 2, and engage in threaded holes provided in vertical walls of the angle pieces 18.

In the vertical side walls 4 of the rear part of the pan 2 there are provided a pair of holes 41 by which the end of two arm rests 20 is fixed to the retention means 10 without loading the pan.

The pan arm rests 20 are fixed to the retention means 10 by a pair of pins 21 which pass through said holes 41 provided in the side walls 4 of the rear part of the pan, and are each fixed, with their horizontal axis lying transversely, to an upper portion 111 of the walls 11.

Each pin 21 has an axial hole 23 through which a screw 22 passes to engage in a threaded hole 28 provided in the respective portion 111, so as to fix the pin 21 to said portion.

To prevent the pin 21 rotating about the axis of the screw 22, each pin possesses two axial pegs 24, each of which is inserted as an exact fit partly into a respective through hole provided in the portion 11 and the remainder into a respective dead hole provided in the pin 21 to the side of the hole 23.

Each arm rest 20 comprises a rigid strong core 27 covered for example with softer polyurethane material.

At one end of the arm rest 20 there is provided a bush 31 rigidly fixed to the core 27 and comprising an axial hole 32 engaging as an exact fit with the pin 21, in such a manner as to form a rotary pair which enables the arm rest 20 to rotate about the axis of the pin 21.

Figures 5, 6:
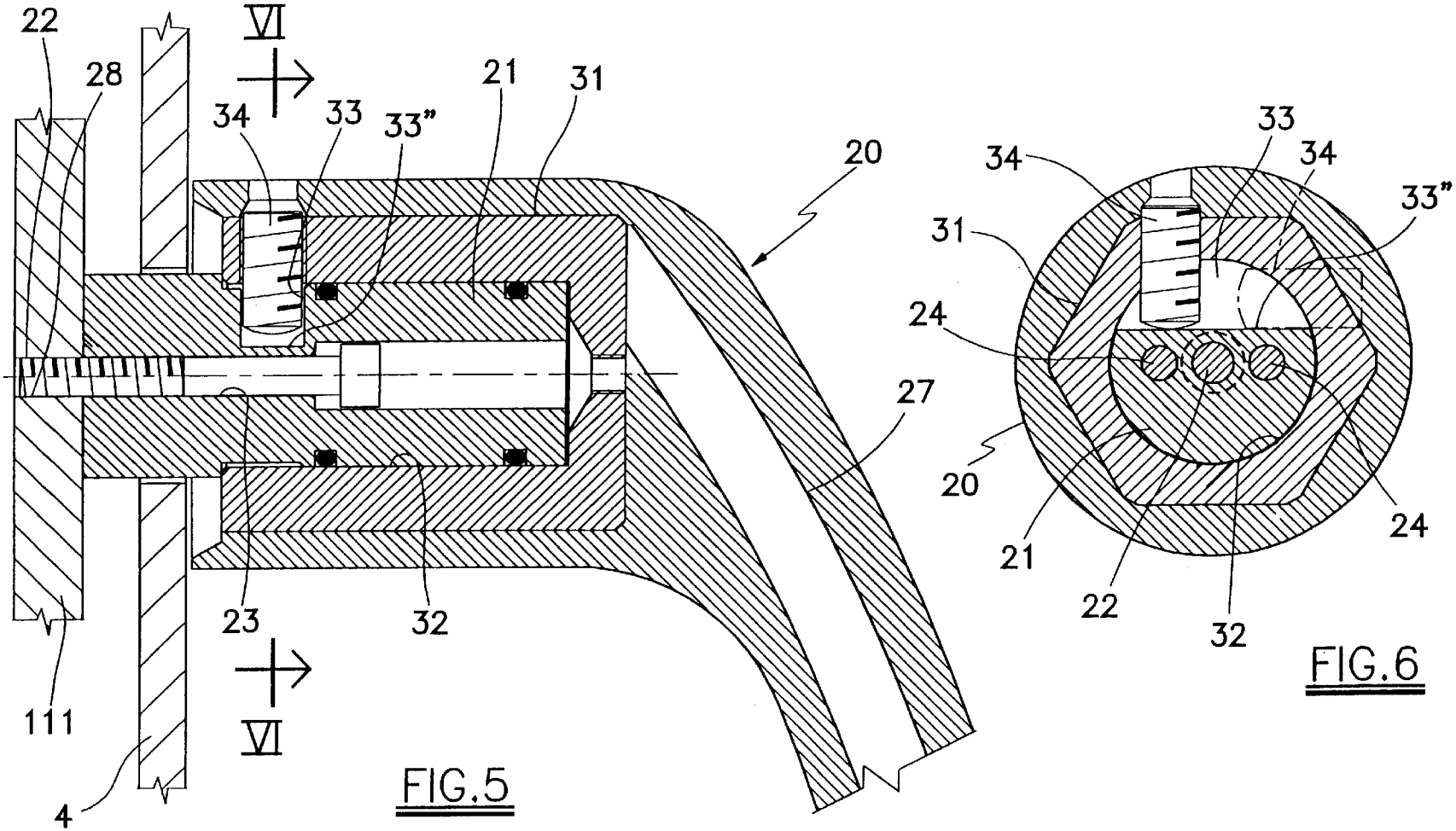
FIG. 5 is a section on the plane V—V of FIG. 3, which shows a first embodiment of the fixing means between the arm rest and retention means.
FIG. 6 is a section on the plane VI—VI of FIG. 4.
Figures 7, 8, 9:
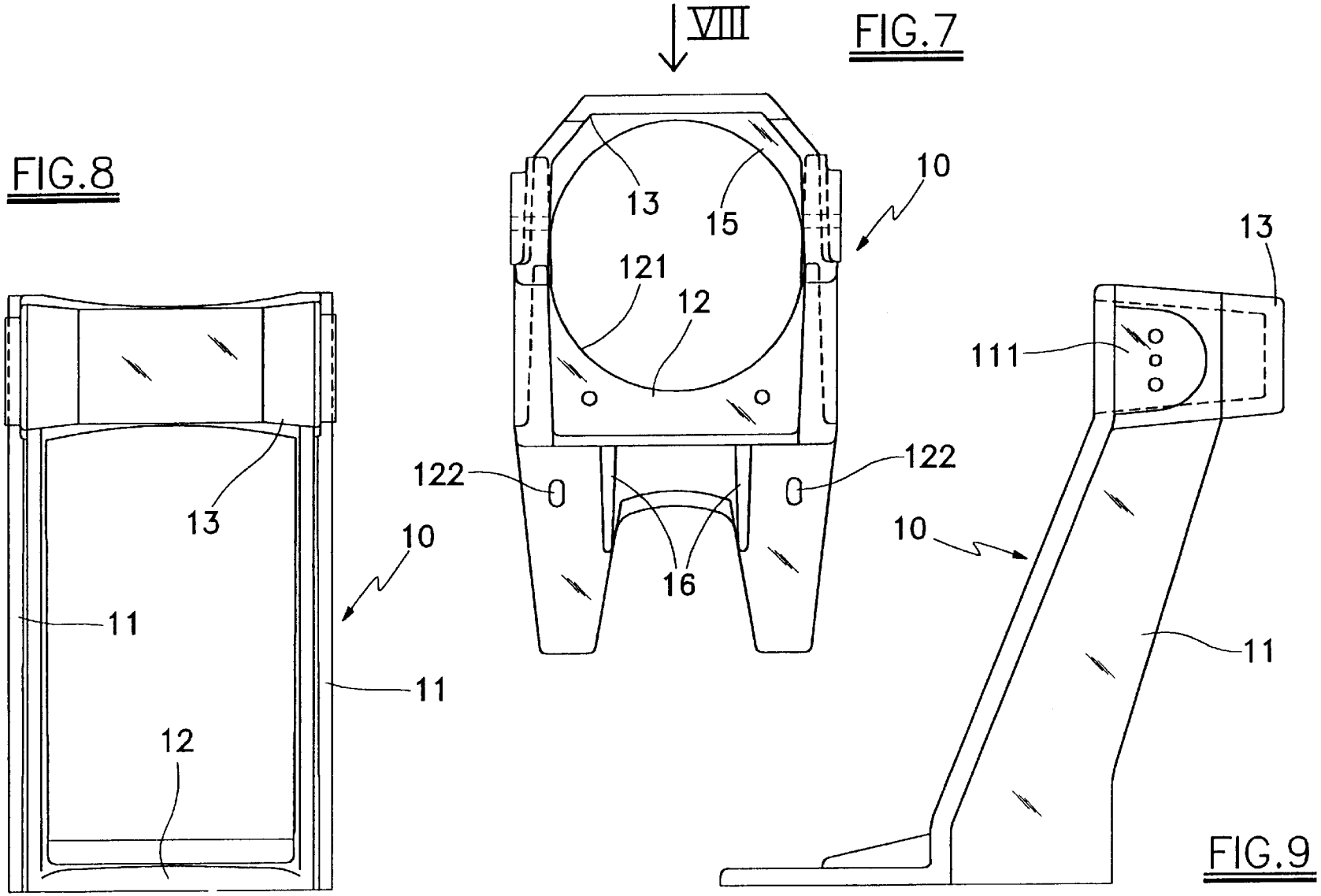
FIG. 7 is a view from above of the retention means of the preceding figure.
FIG. 8 is a view in accordance with the arrow VIII of FIG. 7.
FIG. 9 is a side view of the retention means of FIG. 7.

In the embodiment shown in FIGS. 5 and 6, each pin 21 comprises a groove 33 having two flat opposing radial faces, and a base surface 33" which extends for a determined angle about the pin axis. Said surface 33" is flat.

Each bush 31 is secured to the respective pin 21 by a threaded transverse peg 34 which engages in a transverse threaded hole provided in the bush 31 and has its inner end portion projecting into the groove 33. The diameter of the peg 34 is substantially equal to the width (ie the axial dimension) of the groove 33, with the result that the bush 31 is axially constrained to the pin 21.

Moreover, the inner end of the peg 34 abuts perpendicularly against the base surface 33" of the groove when the arm rest is in a lower angular position, ie corresponding to the normal arm rest utilization position. On rotating the arm rest 20 upwards (to aid the user in sitting on and rising from the pan) the peg 34 rises from the surface 33" for a certain angular distance, then again returns into contact with it (as shown by dashed lines in FIG. 6) to determine the completely raised position of the arm rest 20. The pin 21 emerges from the pan 2 through a respective hole 41 provided in the wall 4 and of diameter slightly larger than the diameter of the pin 21 to prevent their mutual contact.

Figure 11:
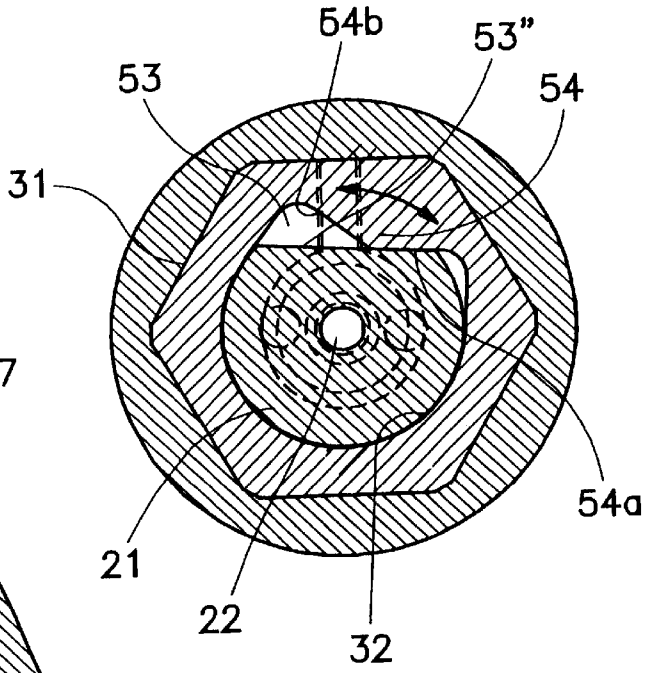
FIG. 11 is a section on the plane XI—XI of FIG. 10.
Figure 10:
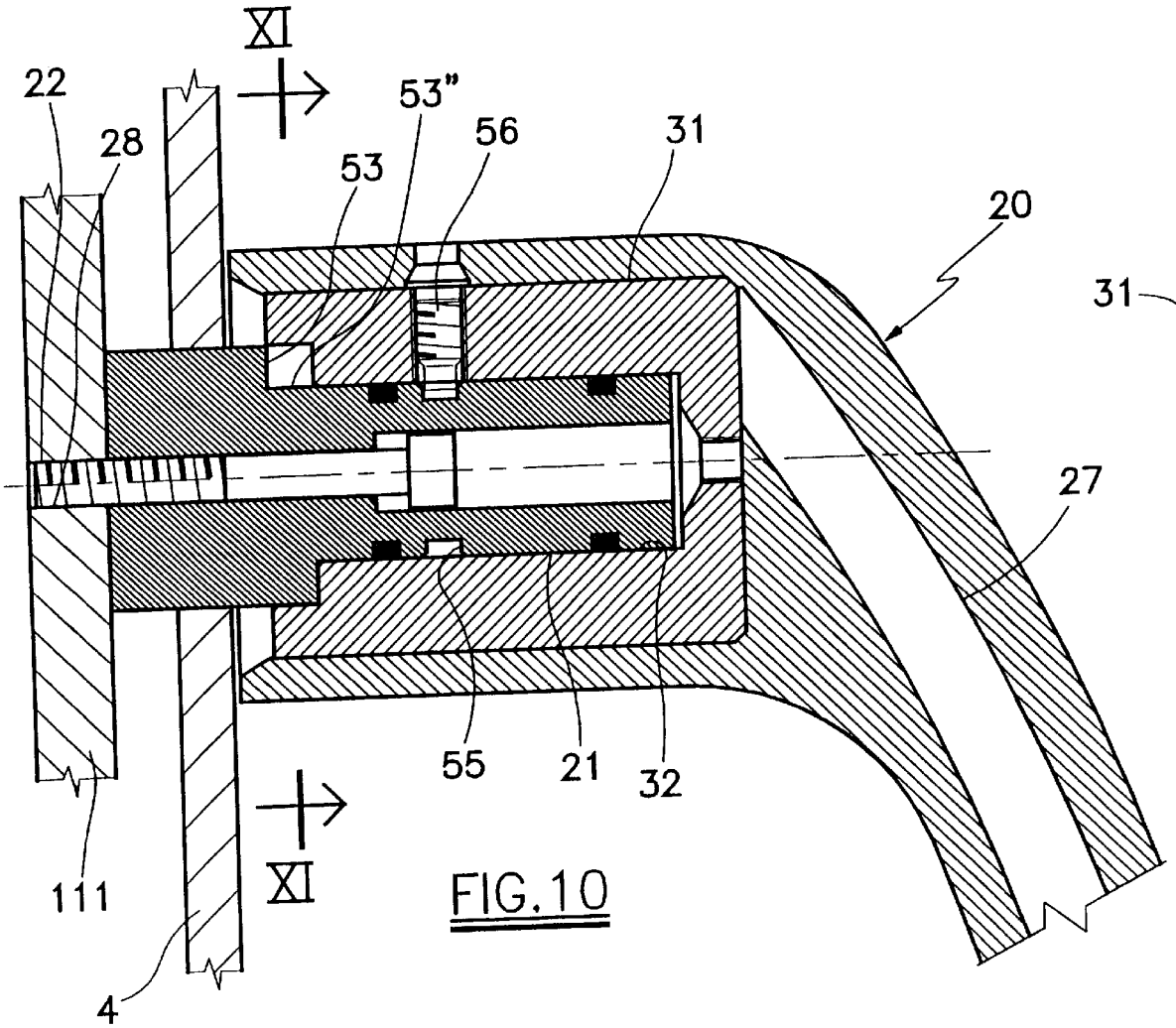
FIG. 10 is a section similar to FIG. 5 of a second embodiment of the fixing means between the arm rest and retention means.
Figure 12:
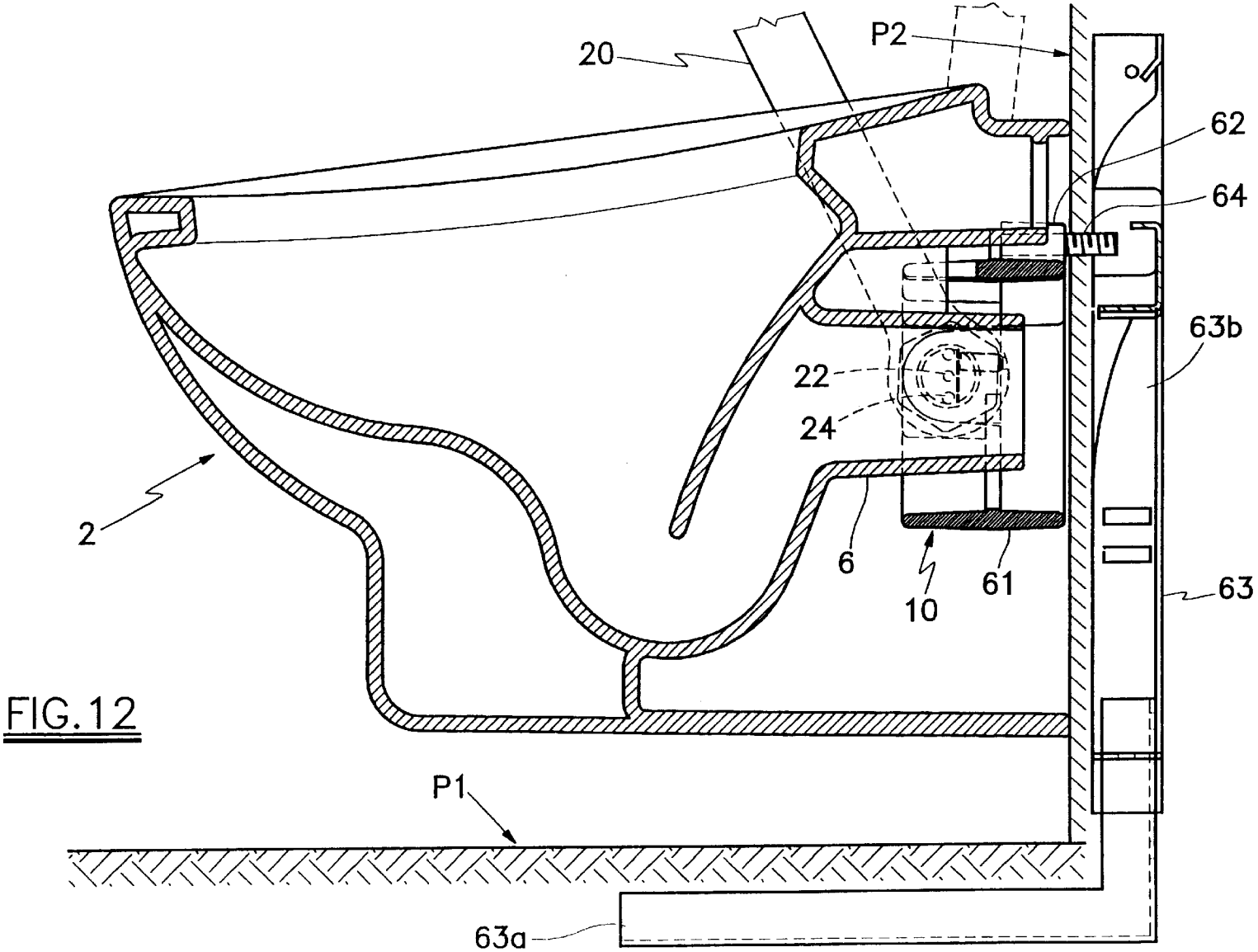
FIG. 12 is a section on the vertical longitudinal plane of symmetry of a water closet with arm rests, according to the invention, in the wall-mounted suspended pan version.
Figure 13:
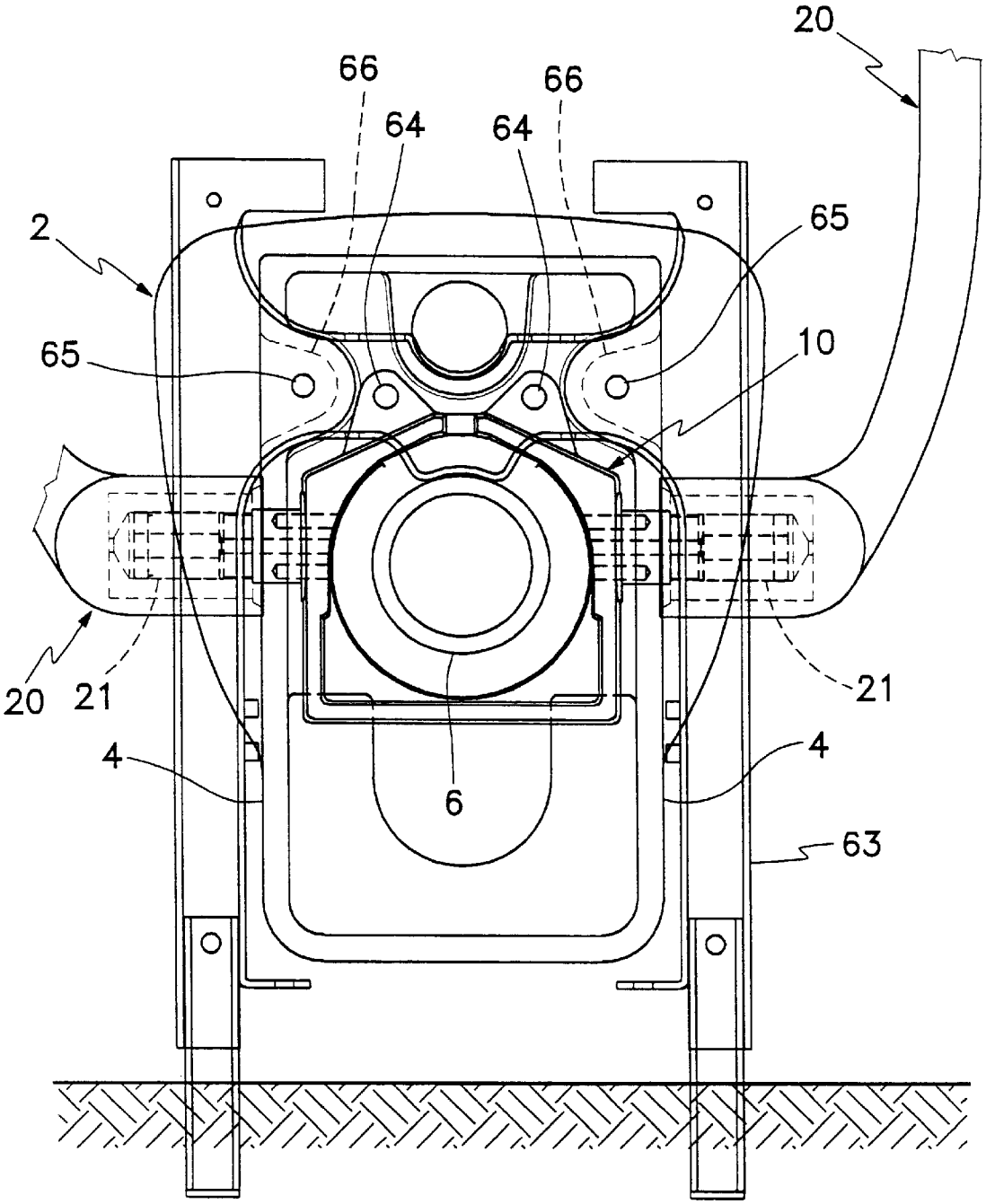
FIG. 13 is a view form the rear, in FIG. 11.
Figure 14:
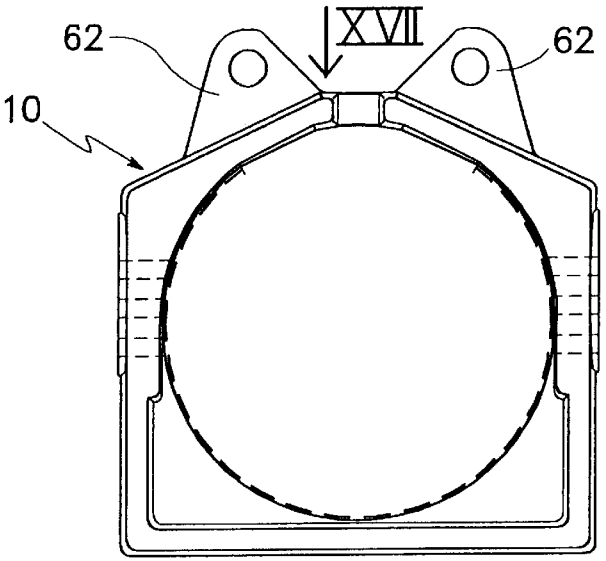
FIG. 14 is a front facing view of the retention means of FIGS. 12 and 13.
Figure 17:
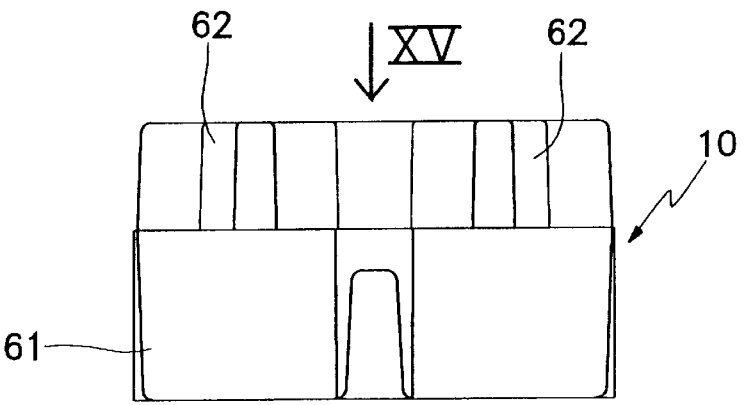
FIG. 17 is a view taken from above in FIG. 1
Figure 15:
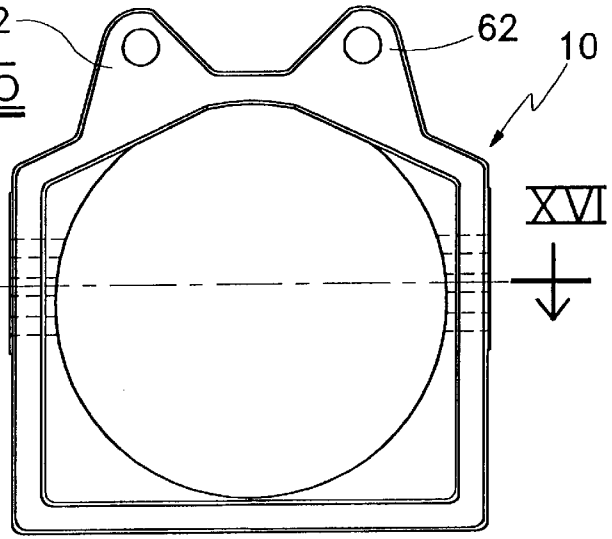
FIG. 15 is a rear facing view of FIG. 14.
Figure 16:
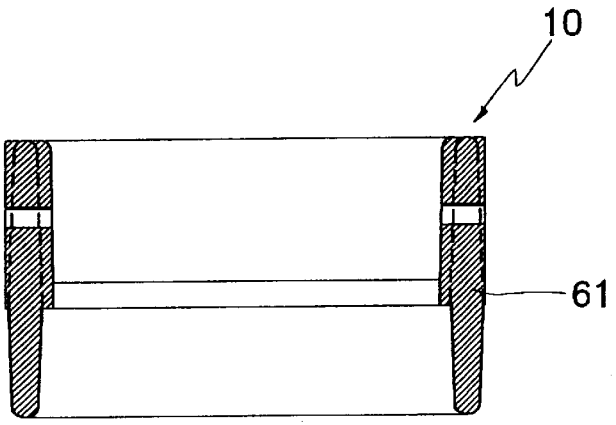
FIG. 16 is a section on the plane XVI—XVI of FIG. 15.

In the embodiment shown in FIGS. 10 and 11, each pin 21 comprises a groove 53 having an outwardly facing open side. Said groove has a base surface 53" which extends through a determined angle about the axis of the pin 21, each bush 31 correspondingly comprising a radial projection 54, positioned within its cavity to define two abutment faces 54*a* and 54*b* opposing the base surface 53". These two faces 54*a* and 54*b* abut against the base surface 53" when the arm rest 20 is in two different angular positions about the axis A of the pin, so as to define two limiting angular positions of the arm rest, namely the lower utilization position of the arm rest and its raised position respectively.

In this embodiment, the pin 21 comprises a second groove 55 extending through 360° and having two parallel opposing flat radial faces, each bush 31 being constrained axially to the respective pin 21 by a threaded transverse peg 56 which is engaged in a transverse threaded hole provided in the bush 31 and has an end portion projecting into the second groove 55.

In both embodiments of the pin 21/bush 31 combination, the bush 31 remains entirely external to the pan 2, with its free end arriving close to the wall 4 but without however touching it.

Consequently the arm rests 20 are completely supported by the retention means 10, to which the thrusts produced by the user on the arm rests are transferred, these thrusts then being transferred to the floor. Moreover the pan does not come into contact with the movable parts of the arm rests.

The pan hence in no way experiences the stresses and constraints caused by the arms 20.

FIGS. 12–17 show an embodiment of the retention means 10 relative to a pan 2 of suspended type, which is wall-mounted. In this embodiment, the retention means 10 comprises a short cylindrical wall 61 to be traversed by the horizontal discharge conduit 6 of the pan 2, and two lugs 62 which are upperly joined to the wall 61 and by which it is fixed to the wall.

A usual support bracket 63 is incorporated into the wall and floor to support the suspended pan. The support bracket 63 has an L-shaped profile with a portion 63*a* embedded in the floor P1 and a vertical portion 63*b* embedded in the wall P2. To this support 63 there are fixed two pins 64 to which the retention means 10 is fixed by the two lugs 62. To the side of the pins 64 the support bracket 63 carries a further two pins 65 to which the pan 2 is directly fixed by two lugs 66 provided on it.

Numerous modifications of a practical and applicational nature can obviously be made to the invention, but without leaving the scope of the inventive idea as hereinafter claimed.

What is claimed is:

1. A water closet pan with arm rests, characterised by comprising:

a retention means (10), arranged to be positioned in a completely hidden manner within the rear part of the pan (2), and to be rigidly fixed to the floor or wall in such a manner as to be supported thereby, and a pair of arm rests (20) which each have one end fixed to the retention means (10) and are supported thereby, the pan (2) being arranged to be fixed to the floor or wall without loading the retention means (10) and vice versa, and having a pair of holes (41) provided in the vertical side walls of its rear part, through which holes the end of the arm rests (20) is fixed to the retention means (10) without loading the pan (2).

2. A water closet with arm rests as claimed in claim 1, characterised by comprising a pair of pins (21) which are fixed to the lateral walls (11) of the retention means (10) with their axis horizontal and transverse and pass through said holes (41) provided in the side walls of the rear part of the pan, and a pair of arm rests (20) each having at one end a bush (31) arranged to rotatingly engage with a respective said pin (21).

3. A water closet with arm rests as claimed in claim 2, characterised in that each said pin (21) comprises a groove (33, 53) having a base surface (33", 53") which extends through a determined angle about the axis of the pin (21), each bush (31) comprising at least one projection (34, 35) which abuts against the base surface (33", 53") of the groove to limit the rotation of the arm rest (20).

4. A water closet with arm rests as claimed in claim 3, characterised in that each said pin (21) comprises a groove (33) having two parallel opposing flat radial faces, each bush (31) being secured to the respective pin (21) by a threaded transverse peg (34) which engages in a transverse threaded hole provided in the bush (31) and has an end portion projecting into the groove (33), the diameter of said end portion of the peg (34) being substantially equal to the axial dimension of the groove (33) and the end of said peg (34) arriving to abut against the base surface (33") of the groove (33) when the arm rest (20) is in two different angular positions about the axis A of the pin, such as to define two limiting angular positions into which the arm rest can rotate.

5. A water closet with arm rests as claimed in claim 3, characterised in that each bush (31) comprises a radial projection positioned within its own cavity to define two abutment faces opposite the base surface (53") which abut against the base surface (53") when the arm rest (20) lies in two different angular positions about the axis of the pin (21), such as to define two limiting angular positions into which the arm rest can rotate.

6. A water closet with arm rests as claimed in claim 5, characterised in that each said pin (21) comprises a second groove (55) having two parallel opposing flat radial surfaces, and each bush (31) is axially constrained to the respective pin (21) by a threaded transverse peg (56) which engages in a transverse threaded hole provided in the bush (31) and has an end portion projecting into the second groove (55).

7. A water closet with arm rests, of the floor-mounted type, as claimed in claim 1, characterised in that said retention means (10) has the overall form of a vertically extending shell, with a base (12) to be fixed to the floor and two vertical facing lateral walls (11) close to the vertical side walls (4) of the rear part of the pan.

8. A water closet with arm rests, of the floor-mounted type, as claimed in claim 7, characterised in that said retention means (10) comprises two parallel, substantially flat vertical lateral plates substantially of L-shape, which define the lateral walls (11), a profiled base (12) which joins together the lower ends of the lateral walls (11) and comprises a cut-out (121) provided in the rear region for passage of a possible discharge conduit, and a U-shaped upper member (13) which joins together the upper portions of the lateral walls (11), leaving the rear lower part of the retention means free.

9. A water closet with arm rests, of the floor-mounted type, as claimed in claim 7, characterised in that the base of the retention means (10) is arranged to be fixed to the floor together with angle pieces (18) which receive usual means (181) for fixing the pan to the angle pieces.

10. A water closet with arm rests, of wall-mounted type, as claimed in claim 1, characterised in that said retention means (10) comprises a short cylindrical wall (61) to be traversed by the horizontal discharge conduit (6) of the pan (2), and two lugs (62) joined upperly to the wall (61) and by which it is fixed to the wall of the room.

* * * * *